US006935250B1

(12) United States Patent
Arnold

(10) Patent No.: US 6,935,250 B1
(45) Date of Patent: Aug. 30, 2005

(54) ADJUSTABLE HEIGHT TABLE WITH MULTIPLE LEGS OPERABLE BY A SINGLE CRANK

(75) Inventor: Roger E. Arnold, Pineville, LA (US)

(73) Assignee: Baker Manufacturing Company, Inc., Pineville, LA (US)

( * ) Notice: Subject to any disclaimer, the term of this patent is extended or adjusted under 35 U.S.C. 154(b) by 0 days.

(21) Appl. No.: 10/267,462

(22) Filed: Oct. 9, 2002

(51) Int. Cl.[7] ..... A47B 9/00
(52) U.S. Cl. ..... 108/147; 248/188.4
(58) Field of Search ..... 108/147, 144, 108/147.11, 147.19; 248/188.1, 188.2, 188.4, 248/188.5

(56) References Cited

U.S. PATENT DOCUMENTS

| | | | | |
|---|---|---|---|---|
| 544,836 | A | | 8/1895 | Vetter |
| 1,243,750 | A | | 10/1917 | Miller |
| 2,532,342 | A | | 12/1950 | Sloane |
| 2,642,996 | A | | 6/1953 | Oeler et al. |
| 2,982,050 | A | | 5/1961 | May |
| 3,140,559 | A | | 7/1964 | Grow et al. |
| 3,273,517 | A | | 9/1966 | Amthor, Jr., et al. |
| 3,364,881 | A | | 1/1968 | Kooi |
| 3,638,584 | A | | 2/1972 | Cisler et al. |
| 3,820,176 | A | | 6/1974 | Feiertag |
| 3,887,155 | A | | 6/1975 | Bertalot |
| 3,908,560 | A | | 9/1975 | Horner |
| 4,130,069 | A | | 12/1978 | Evans et al. |
| 4,469,029 | A | | 9/1984 | Ramond |
| 4,591,214 | A | | 5/1986 | Reuter et al. |
| 4,615,279 | A | * | 10/1986 | de la Haye ..... 108/147 |
| 4,637,322 | A | | 1/1987 | Hampshire et al. |
| 4,751,884 | A | | 6/1988 | Ball |
| 4,981,085 | A | | 1/1991 | Watt |

(Continued)

*Primary Examiner*—Jose V. Chen
(74) *Attorney, Agent, or Firm*—Garvey, Smith, Nehrbass & Doody, L.L.C.; Charles C. Garvey, Jr.

(57) ABSTRACT

An improved elevating table apparatus provides a plurality of at least three telescoping legs that support a table top having an underside and an upper surface that provides a work surface upon which can be placed computers, office equipment and the like. A gear cluster is provided at the top of each leg that includes a plurality of gears, preferably bevel gears, that are engaged during use. Each leg has a hollow interior that holds a generally vertically extending, externally threaded rod, the rod having an upper end portion with a gear that forms a part of the gear cluster and a lower end portion that threadably engages a section of the leg. A single crank provides a drive shaft with a gear that forms a part of one of the gear clusters. A plurality of connecting linkages or connecting rods are provided that connect a center of the gear clusters to each of a pair of side gear clusters. When the single crank is rotated, all of the gear clusters and connecting rods or linkages rotate, each connecting rod or linkage having a gear at a connecting rod or linkage end portion that forms a part of a gear cluster. In this fashion, the crank can be rotated in one rotational direction that extends the length of each of the legs and elevates the table top. When the crank is rotated in an opposite rotational direction, all of the legs shorten in length so that the table top is lowered.

29 Claims, 6 Drawing Sheets

U.S. PATENT DOCUMENTS 5,041,770 A 8/1991 Seiler et al.
5,230,290 A * 7/1993 Crossman ..... 108/147
5,289,782 A 3/1994 Rizzi et al.
5,322,025 A 6/1994 Sherman et al.
5,323,695 A 6/1994 Borgman et al.
5,339,750 A 8/1994 Smies
5,370,063 A 12/1994 Childers
5,408,940 A 4/1995 Winchell
5,845,590 A * 12/1998 Seidl ..... 108/147
5,890,438 A * 4/1999 Frankish ..... 108/147
6,148,741 A * 11/2000 Motta ..... 108/147
6,289,825 B1 * 9/2001 Long ..... 108/147
6,474,246 B2 * 11/2002 Hsu ..... 108/147

* cited by examiner

ADJUSTABLE HEIGHT TABLE WITH MULTIPLE LEGS OPERABLE BY A SINGLE CRANK

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to height adjustable tables. More particularly, the present invention relates to an improved height adjustable table that provides a plurality of legs that are simultaneously adjustable. A specially configured gear and drive shaft configuration telescopes all of the legs simultaneously to either raise or lower a table top supported by the legs responsive to rotation of a single crank.

2. General Background of the Invention

Adjustable tables have been in use for many years. There are several adjustable height tables that are commercially available. Several of these adjustable height tables were patented as drafting tables. Several of these patented commercially available tables were sold under the trademark Hamilton. Patents relating to Hamilton® drafting tables that have been sold for many years are U.S. Pat. Nos. 3,140,559 and 3,273,517).

One of the primary uses for adjustable height tables is the support of a heavy object such as a computer and/or monitor at a comfortable elevation for the user. Because computers and monitors are relatively heavy, a problem exists when the table is at a maximum elevational position such as when the user chooses to stand. In such a situation, adjustable height tables can become top heavy and suffer from lateral instability. The weighted table top of the table tends to deflect when it is elevated to a high position and when it is loaded with a heavy object such as a monitor, computer or the like. In order to stabilize a table top, often three or more legs are placed in triangular position. When a table top is extremely large, three legs are preferably employed rather than two legs having laterally extending feet. For a table with three legs, height adjustment requires that all three legs either elevate or lower simultaneously. Many patents have issued that are directed to elevating or height adjustable tables. Early patents that show adjustable height tables are shown for example in U.S. Pat. Nos. 5,448,36; 1,243,750; 2,532,342; and 2,642,996;

The May Patent discloses an adjustable support for a drafting table. In the May U.S. Pat. No. 2,982,050, an adjustable drafting board support that includes a pair of links that swing to elevate and lower the board and an improved arrangement for counterbalancing the board to apply a substantially uniform lift to the board in all operative positions.

The Grow U.S. Pat. No. 3,140,559 discloses a drafting table that uses a rack and pinion arrangement in combination with a locking or braking mechanism which is adapted to lock the vertically adjustable table in any selected position when the operating linkage has been released and which lock will become even more securely locked upon the application of downward pressure on the table top occurring in normal use.

The Kooi U.S. Pat. No. 3,364,881 discloses a drafting table with a single pedal control of both vertical movement and tilting. U.S. Pat. No. 3,638,584 discloses a drafting table that includes a pedestal, support columns associated with the pedestal for vertical movement and a drafting board on an upper portion thereof. An elevating table is disclosed in the Feiertag U.S. Pat. No. 3,820,176.

A telescoping support arm of quadrangular cross-section is disclosed in the Bertalot U.S. Pat. No. 3,887,115. The apparatus provides roller bearings in corner spaces between each tube surrounding each other, the rollers in one corner rolling over separate braces supported on resilient means urging the rollers and the inner tube toward the other corner so as to exclude backlash.

The Horner U.S. Pat. No. 3,908,560 discloses a counter balancing system for a drafting table.

A vertically adjustable drafting table is disclosed in the Evans U.S. Pat. No. 4,130,069.

The Raymond U.S. Pat. No. 4,469,029 discloses a workstation comprised of support legs with a stable support base and the uprights on which pivoting elbows are adapted to form adjacent arms which are positioned and locked in place in an adjustable angular manner at one of these end of the arms, the other end bearing supports are work tops positioned and locked in place in a manner which can be angularly adjusted at will, so that these supports or work tops allow effects and uses which are multiple and can be combined together.

U.S. Pat. No. 4,591,214 issued to Reuter discloses a cabinet closure assembly that includes a panel which is pivotable between opening-blocking and opening-unblocking positions. The Kurrasch U.S. Pat. No. 4,619,208 discloses a work surface height adjustment mechanism.

An adjustable computer work table is disclosed in U.S. Pat. No. 4,637,322. Vertically actuating scissor arms are provided for moving the support shaft upward and downward whereby providing a vertical adjustment.

The Ball U.S. Pat. No. 4,751,884 discloses a height adjustable work top. The work top is adjustable and may tilt about a horizontal axis near the front edge. The work top may be mounted in an open office beam system or an office screen or partition in cantilever fashion or it may be a free standing unit.

A table lift mechanism is disclosed in the Watt U.S. Pat. No. 4,981,085. The '085 patent discloses furniture having a top or the like supported for vertical movement by telescoping legs supports with a counter balance for exerting a relatively uniform counter balance force from the top throughout its range of vertical movement. A latch mechanism is provided for latching the top in the selected vertical positions, and an adjustable roller guide mechanism as provided for coupling the telescoping elements of the legs supports.

An apparatus for adjusting a computer work station to individual needs is disclosed in the Seiler U.S. Pat. No. 5,041,770.

An adjustable height table is disclosed in the Rizzi U.S. Pat. No. 5,289,782. The '782 patent discloses a table having a top that can be vertically adjusted to various heights by a pair of telescoping legs and a counter balance weight mechanism which includes a weight box and weights that can be easily added or removed by the user depending on the weight carried by the table top. A locking mechanism including a spring urged threaded half nut and a stationary threaded rod enables the table top to be locked in place once a desired height is achieved.

An adjustable dual work surface support is disclosed in the Sherman, et al, U.S. Pat. No. 5,332,025. The Borgman, et al, U.S. Pat. No. 5,323,695 discloses a method of using a work station having separate and back tops having separate power drive arrangements while permitting independent height adjustment. A controller, which is programed by an operator, permits storage of a number of predetermined height locations each defining distinct heights for the tops. The operator effects programed movement of the tops to predetermined height locations for predetermined times in a predetermined sequence, with the rear top moving initially and a front top moving thereafter.

The Smies U.S. Pat. No. 5,339,750 discloses an adjustable work table. The '750 patent table comprises a base and at least one movable extensible vertical column attached to the base having a table top carried on the vertical column. A pivot is provided for moving the table top into any of a range of pivoted positions, preferably on both sides of the horizontal position of the table top. A motor is provided for holding the table top in any of the range of pivoted positions.

A non-binding cantilevered table lifting device disclosed in the Childers U.S. Pat. No. 5,370,063.

The Winchell U.S. Pat. No. 5,408,940 discloses an adjustable height work surface with rack and pinion arrangements.

BRIEF SUMMARY OF THE INVENTION

The present invention provides an improved height adjustable table apparatus that includes a table top having an underside to which legs are affixed and an upper surface that provides a work area or work surface.

A plurality of telescoping legs attach to and support the table top. The legs each include a fixed section and a moving section. Each leg provides a lower end portion and an upper end portion. The upper end portion of each leg attaches to the table top underside with a gear box arrangement interface. This gear box arrangement includes a gear cluster that is mounted at the top of each leg that includes a plurality of gears that can be bevel gears.

Each leg provides a hollow interior that holds a generally vertically extending, externally threaded rod. The rod provides an upper end portion with a bevel gear that forms part of the gear cluster and a lower end portion that threadably engages a lower leg section.

A single crank is attached to a drive shaft. A gear that forms a part of the gear cluster is mounted on one end portion of the drive shaft and generally opposite the crank.

A plurality of connecting rods connect each gear cluster to another of the gear clusters. When the single crank is rotated, all of the connecting rods rotate, each connecting rod having a gear at a connecting rod end portion that forms part of the gear cluster. The gear clusters and connecting rods are so configured that when the single crank is rotated by a user in a first rotational direction, all three legs elevate the table top. To lower the table top, a user rotates the crank in the opposite rotational direction.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
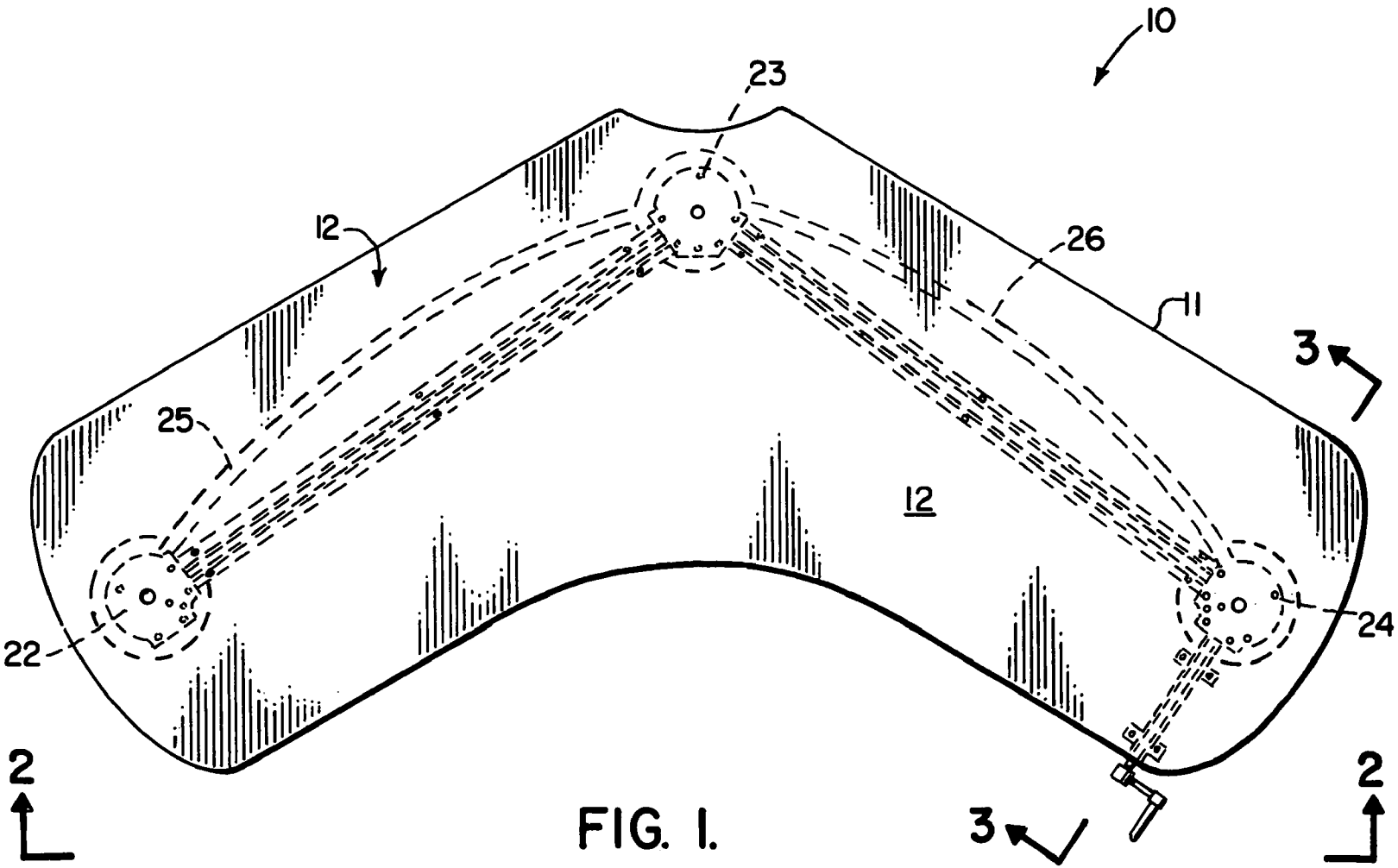
FIG. 1 is a plan view of the preferred embodiment of the apparatus of the present invention.
Figure 2:
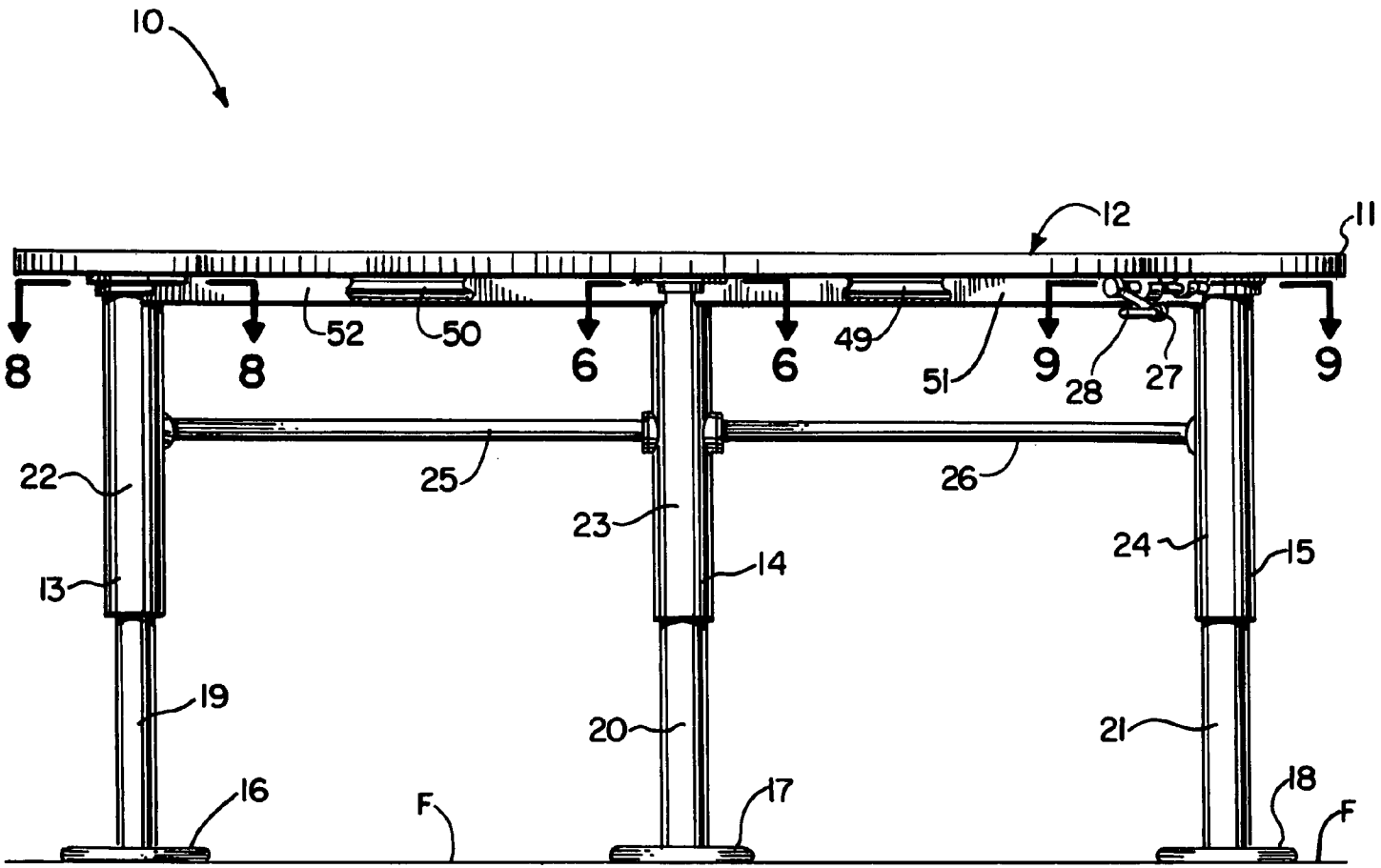
FIG. 2 is an elevation view of the preferred embodiment of the apparatus of the present invention taken along lines 2—2 of FIG. 1.

FIGS. 1 and 2 show generally the preferred embodiment of the apparatus of the present invention designated generally by the numeral 10. Height adjustable table 10 provides a top 11 having a work surface 12. The top 11 can be of any selected material that can function as a table top such as for example wood, plastic, metal, a laminate material or the like. Table top 11 is supported by a plurality of telescoping legs 13, 14 and 15. Each of the legs 13, 14, 15 preferably provides an enlarged foot for engaging an underlying support surface such as the floor F shown in FIG. 2. The leg 13 provides foot 16. The leg 14 provides foot 17. The leg 15 provides foot 18.

Each of the telescoping legs 13, 14, 15 is comprised of an inner section and an outer section. The leg 13 has an inner section 19 and an outer section 22. The leg 14 has an inner section 20 and an outer section 23. The leg 15 has an inner section 21 and an outer section 24. Connecting braces 25, 26 can be provided for stabilizing each of the legs 13, 14, 15 as shown in FIG. 2. The connecting brace 25 extends between the outer sections 22, 23 of legs 13, 14 respectively. Similarly, the connecting brace 26 extends between the outer sections 23 and 24 of the legs 14, 15 respectively.

A single rotary crank 27 is provided for simultaneously elevating each of the outer sections 22, 23, 24 of the legs 13, 14, 15 relative to the inner sections 19, 20, 21 so that the table top 11 rises or falls uniformly. The table work surface 12 remains level and preferably defines a substantially horizontal plane at all times during elevation or lowering.

Figures 3, 4:
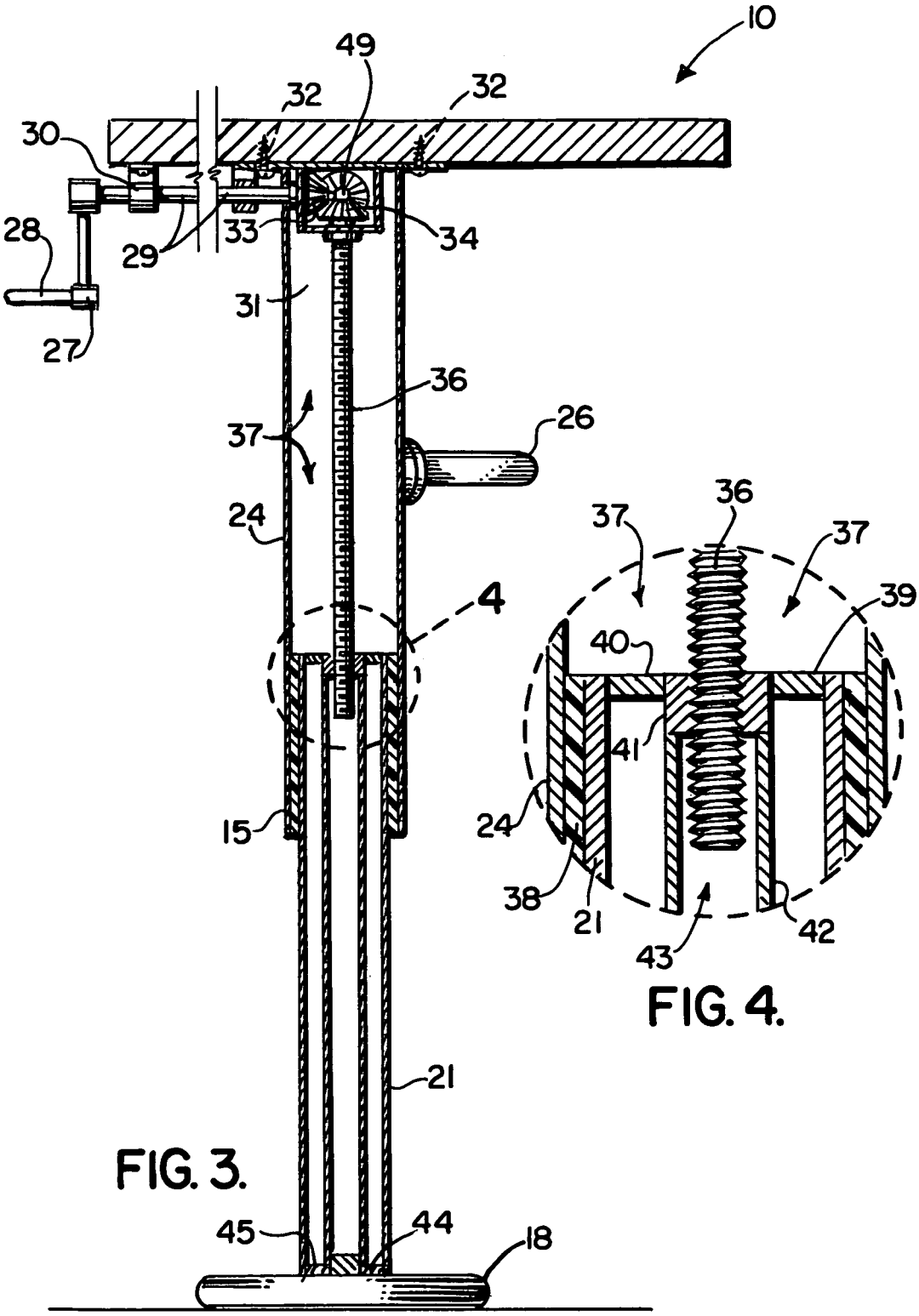
FIG. 3 is a sectional view taken along lines 3—3 of FIG. 1.
FIG. 4 is a fragmentary view of the preferred embodiment of the apparatus of the present invention.
Figure 5:
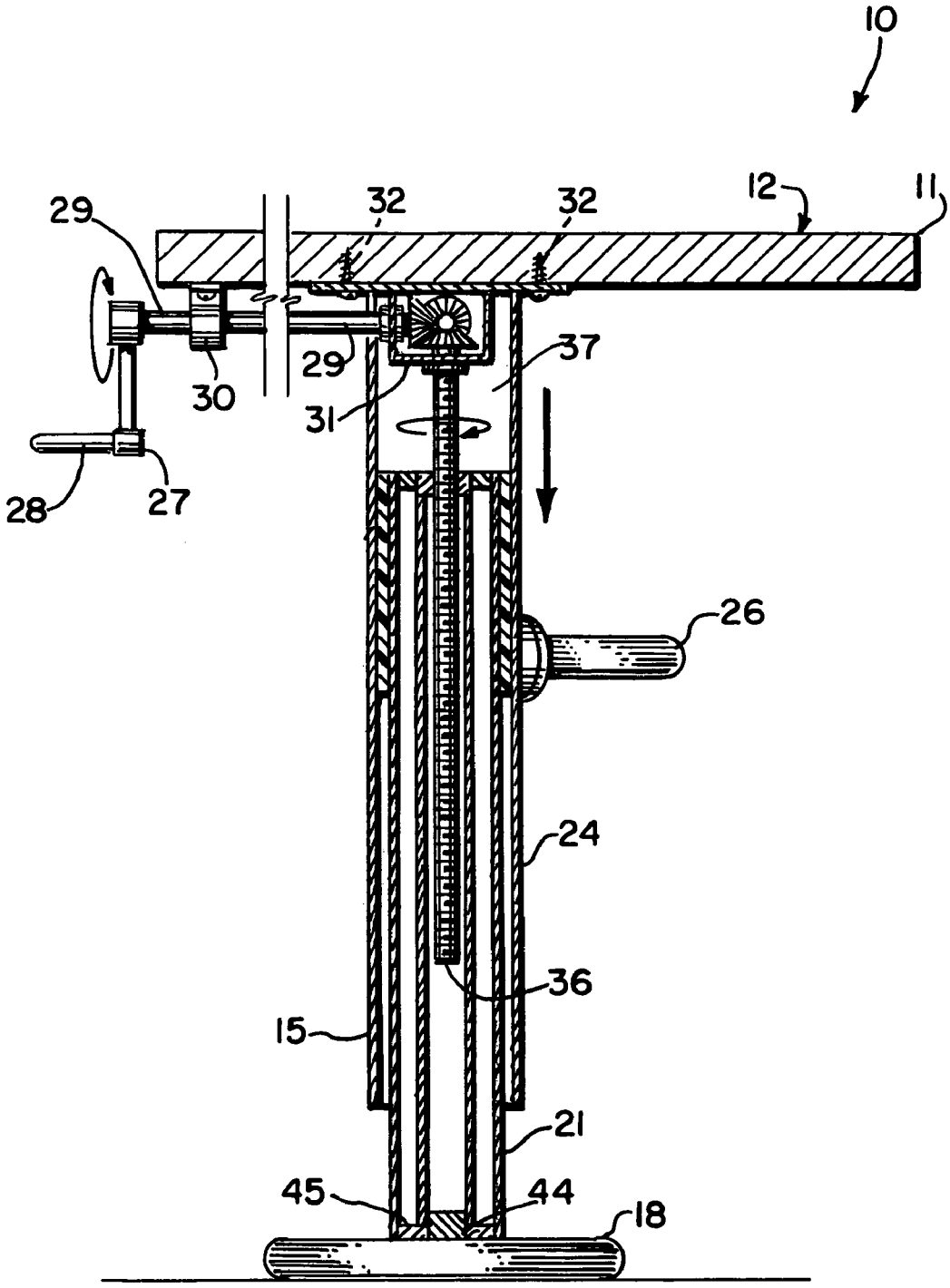
FIG. 5 is a sectional elevation view of the preferred embodiment of the apparatus of the present invention.

Crank 27 is preferably manually operated using handle 28. Crank 27 can be motor (eg. electric) operated. The handle 28 and crank 27 connect to drive shaft 29 as shown in FIGS. 1, 3 and 5. Bevel gear 33 can be removably mounted to an end portion of drive shaft 29, generally opposite crank 27. The shaft 29 could be a flexible shaft or a multi-piece shaft with universal gears to change the position of the crank 27 handle 28. Shaft 29 preferably has a hex shaped end portion that fits into a hex shaped socket or opening in gear 33. A bearing 30, bushing or the like guide can be used to support drive shaft 29 as it extends from crank 27 to gear housing 31 and beveled gear 33. Bearing 30 supports shaft 29 while it rotates during use when elevating or lowering table top 11. The gear housing 31 can be attached to top bracket 40 which is mounted to the underside of table top 11 using threaded fasteners 32 such as wood screws or sheet metal screws.

A feature of the present invention is that when the crank 27 is rotated, a provided gear arrangement simultaneously rotates a vertical, threaded shaft 36 located inside of each of the legs 13, 14, 15. The detail shown in FIGS. 3 and 4 for a single leg 14 is the same basic construction that is used for each of the other legs 13, 15.

In FIGS. 3 and 4, the inner section 21 of leg 15 fits within interior 37 of outer section 24 in telescoping fashion. As an interface between the inner section 21 and outer section 24, there can be provided a cylindrically shaped (e.g. polymeric) bearing 38 as shown in FIG. 4.

At its upper end portion, threaded shaft 36 extends to gear housing 31 and connects with bevel gear 34. At an opposing, lower end portion, the elongated vertical threaded shaft 36 connects with internally threaded nut 41 that is mounted to the top of sleeve 42. The sleeve 42 extends from nut 41 downwardly to an attachment 44 that joins leg inner section 21 to foot 18 at circular plate 45. Sleeve 42 is hollow, having interior 43. The connection of sleeve 42, plate 45, and foot 18 can be an attachment 44 that is either bolted or welded, as examples. As table top 11 is lowered, shaft 36 extends into interior 43 of sleeve 42.

For each of the legs 13 and 15, the thread pattern for the threads on vertical threaded shaft 36 are the same. A reverse thread is provided for the threaded shaft 36 that occupies the center leg 14. A reverse threading of the threaded shaft 36 is provided for the center leg 14 to insure that all three legs 13, 14, 15 elevate at the same time when crank 27 is rotated in a first rotational direction. Similarly, all three legs 13, 14, 15 are lowered (see FIG. 5) at the same time when crank 27 is rotated in a second rotational direction (see FIG. 3).

Figure 8:
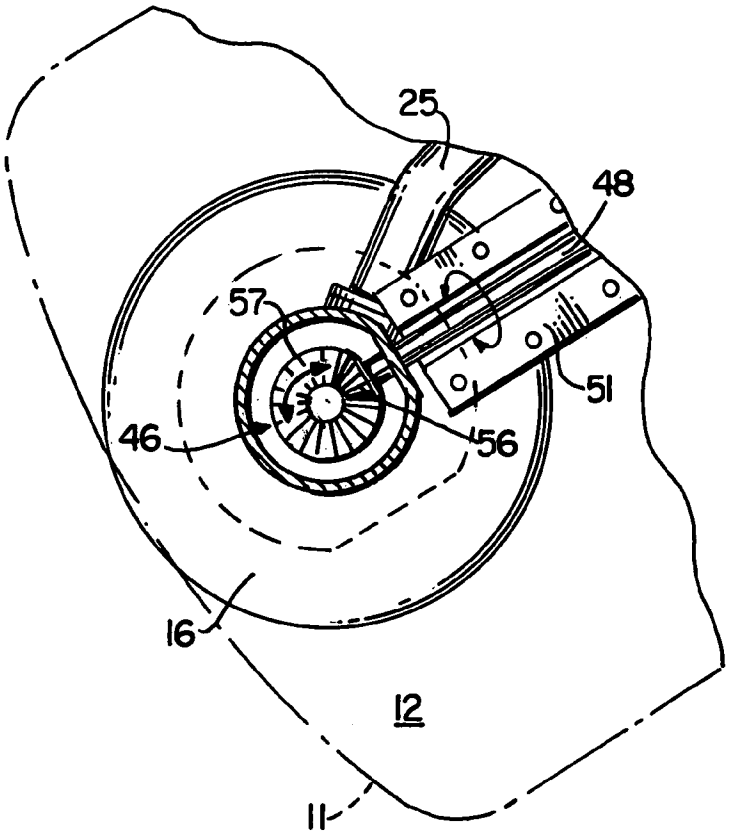
FIG. 8 is a sectional view taken along lines 8—8 of FIG. 2.

There are three gear housings, one at the top of each leg 13, 14, 15. In FIG. 8, the gear housing for leg 13 is designated by the numeral 46. The gear housing for the leg 14 is designated by the numeral 47. As described above, the gear housing for the leg 15 is designated by the numeral 31.

An elongated, generally horizontally positioned connecting rod 48 spans between the gear housings 46, 47. Similarly an elongated, generally horizontally positioned connecting rod 49 spans between the gear housings 47, 31. Each rod 48, 49 has end portions that attach to a bevel gear mounted next to each of its end portions. In the preferred embodiment, rods 48 and 49 have hexagonally shaped ends that fit into a hex shaped socket or opening in the bevel gear to which rod 48 or 49 attaches.

Figure 9:
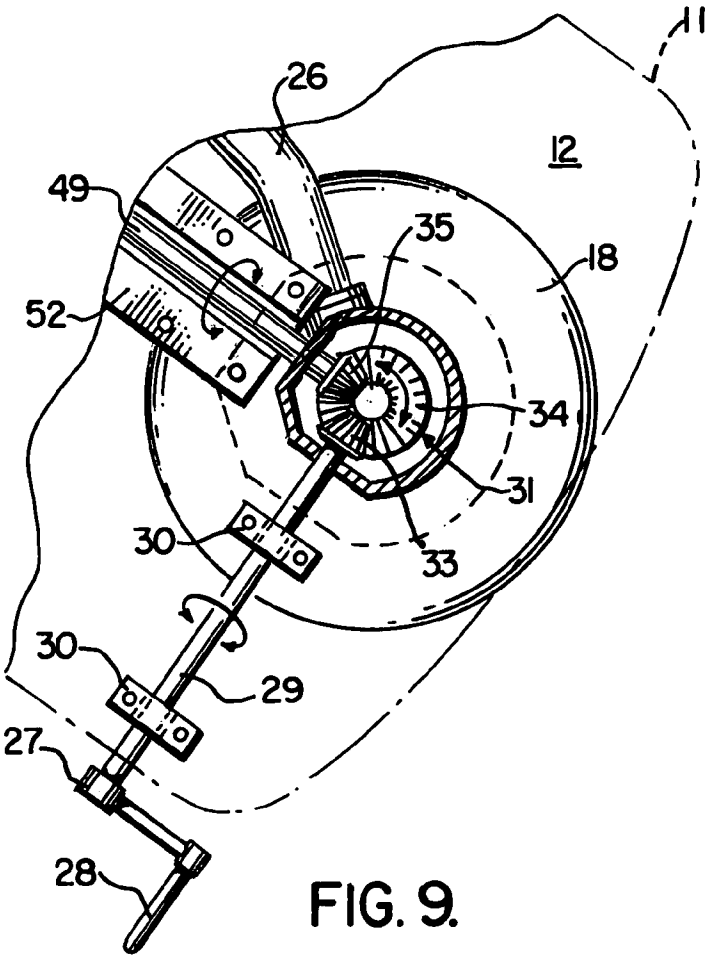
FIG. 9 is a sectional view taken along lines 9—9 of FIG. 2.

When crank 27 is rotated in a first rotational direction, the table top 11 elevates as the legs 13, 14, 15 extend and elongate. When crank 27 is rotated in an opposite rotational direction, the table top lowers as the legs 13, 14, 15 retract and shorten. Connecting rod 49 is a linkage that has bevel gears 35, 54 at its end portions (see FIGS. 6 and 9). Gear 35 engages gears 33 and 34 (see FIGS. 3, 5, 9). Gear 54 engages gears 53 and 55 (see FIG. 6).

Figure 6:
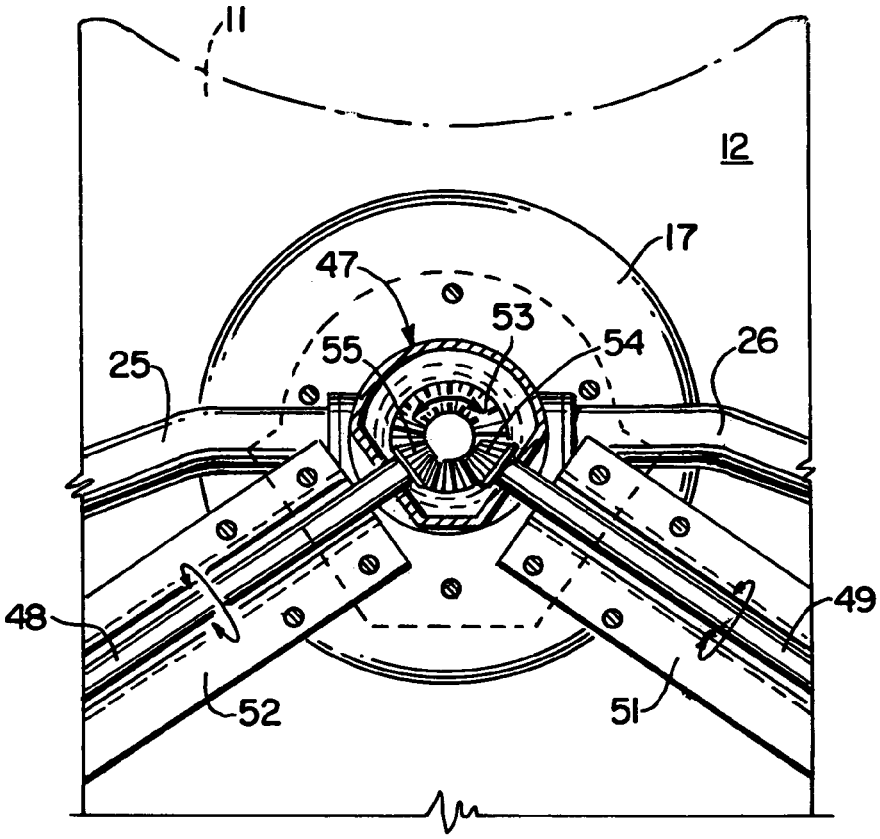
FIG. 6 is a sectional view taken along lines 6—6 of FIG. 2.

Rod or linkage 48 has gears 55, 56 at its end portions (see FIGS. 6, 8). Each rod 48, 49 is contained within a protective tray 51, 52. The legs 13, 14, 15 have threaded rods 36, each with a gear 34, 53, 57 at the top thereof (as in FIGS. 3 and 5). The above described gearing enables all three legs 13, 14, 15 to simultaneously elevate or to lower depending upon the rotational direction of the crank 27.

Figure 7:
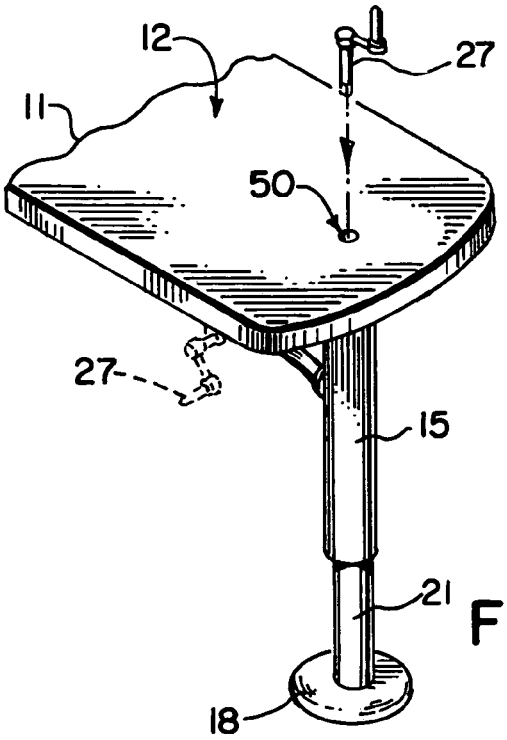
FIG. 7 is a partial perspective view of the preferred embodiment of the apparatus of the present invention.

As an alternate location for crank 27, a socket 50 in table top 11 (see FIG. 7) can optionally be provided. Crank 27 can be configured to engage the top of gear 34 that is associated with leg 15 as shown (or leg 13 or 14 if desired). Crank 27 can have a socket or a projection that connects with a correspondingly shaped projection or socket on the top of gear 34, so that when crank 27 extends into socket 50 of table top 11, the crank 27 can form and transmit torque and rotation to gear 34. Thus, the crank 27 can be removably connected to leg 15 as shown, or similarly connected to leg 13 or 14.

PARTS LIST

The following is a list of suitable parts and materials for the various elements of the preferred embodiment of the present invention.

| Part No. | Description |
|---|---|
| 10 | height adjustable table |
| 11 | top |
| 12 | work surface |
| 13 | telescoping leg |
| 14 | telescoping leg |
| 15 | telescoping leg |
| 16 | foot |
| 17 | foot |
| 18 | foot |
| 19 | inner section |
| 20 | inner section |
| 21 | inner section |
| 22 | outer section |
| 23 | outer section |
| 24 | outer section |
| 25 | connecting brace |
| 26 | connecting brace |
| 27 | crank |
| 28 | handle |
| 29 | drive shaft |
| 30 | bearing |
| 31 | gear housing |
| 32 | fastener |
| 33 | bevel gear |
| 34 | bevel gear |
| 35 | bevel gear |
| 36 | threaded shaft |
| 37 | interior |
| 38 | bearing |
| 39 | upper end |
| 40 | top bracket |
| 41 | internally threaded nut |
| 42 | sleeve |
| 43 | hollow interior |
| 44 | attachment |
| 45 | circular plate |
| 46 | gear housing |
| 47 | gear housing |
| 48 | connecting rod |
| 49 | connecting rod |
| 50 | socket |
| 51 | tray |
| 52 | tray |
| 53 | gear |
| 54 | gear |
| 55 | gear |
| F | floor |

The foregoing embodiments are presented by way of example only; the scope of the present invention is to be limited only by the following claims.

What is claimed is:

1. An elevating table apparatus, comprising:

a) a table top having an underside and an upper surface that provides a work surface;

b) a plurality of three telescoping legs attached to and supporting the table top, one leg being a center leg, the legs each comprising a lower, smaller fixed section and an upper, larger movable section, each leg having a lower end portion and an upper end portion and wherein the lower section fits inside the upper section and the sections telescope relative to one another;

c) a gear cluster at the top of each leg that includes a plurality of gears that are engaged during use;

d) each leg having a hollow interior that holds a generally vertically extending, externally threaded rod, the rod having an upper end portion with a gear that forms a part of the gear cluster and a lower end portion that threadably engages a leg lower section;

e) a crank having a drive shaft with a gear that forms a part of the gear cluster;

f) a plurality of connecting rods that connect each gear cluster to another of the gear clusters so that when the crank is rotated, all of the connecting rods rotate, each connecting rod having a gear at a connecting rod end portion engaging part of the gear cluster; and g) a plurality of transverse support bars that span between the upper, larger movable leg sections, each transverse bar spanning between the center telescoping leg and another of the telescoping legs at a position spaced below the table top.

2. The elevating table apparatus of claim 1 wherein each gear cluster includes at least one bevel gear.

3. The elevating table apparatus of claim 1 wherein each gear cluster includes a plurality of bevel gears.

4. The elevating table apparatus of claim 1 wherein the crank is configured to be manually rotatable.

5. The elevating table apparatus of claim 1 wherein the legs include a center leg in between two other legs.

6. The elevating table apparatus of claim 1 wherein each leg lower fixed section fits inside of a leg upper movable section.

7. The elevating table apparatus of claim 1 wherein each connecting rod extends next to the underside of the table top.

8. The elevating table apparatus of claim 1 wherein each gear cluster has a gear housing connected to the table top underside.

9. The elevating table apparatus of claim 8 wherein there are three gear housings that each are three bevel gears.

10. An elevating table apparatus, comprising:

a) a table top having an underside and an upper surface that provides a work surface;

b) a plurality of three telescoping legs attached to and supporting the table top, the legs each comprising a lower smaller diameter fixed section that fits inside of an upper larger diameter movable section, each leg having a lower end portion and an upper end portion;

c) a gear cluster at the top of each leg that includes a plurality of gears that are engaged;

d) each leg having a hollow interior that holds a generally vertically extending, externally threaded rod, the rod having an upper end portion with a gear that rotates with the rod and forms a part of the gear cluster and a lower end portion that threadably engages a leg lower section;

e) a crank having a drive shaft with a gear that forms a part of one of the gear clusters;

f) a plurality of connecting rods that connect each gear cluster to another of the gear clusters so that when the crank is rotated, all of the connecting rods rotate, each connecting rod connecting to a gear that forms a part of a gear cluster at a connecting rod end portion; and g) a plurality of transverse support bars that span between the upper, larger movable leg sections, each transverse bar spanning between the center telescoping leg and another of the telescoping legs at a position spaced below the table top.

11. The elevating table apparatus of claim 10 wherein each gear cluster includes at least one bevel gear.

12. The elevating table apparatus of claim 10 wherein each gear cluster includes a plurality of bevel gears.

13. The elevating table apparatus of claim 10 wherein the crank is configured to be manually rotatable.

14. The elevating table apparatus of claim 10 wherein the legs include a center leg in between two other legs.

15. The elevating table apparatus of claim 10 wherein each leg lower fixed section fits inside of a leg upper movable section.

16. The elevating table apparatus of claim 10 wherein each connecting rod extends next to the underside of the table top.

17. The elevating table apparatus of claim 10 wherein each gear cluster has a gear housing connected to the table top underside.

18. The elevating table apparatus of claim 17 wherein there are three gear housings that each are three bevel gears.

19. The elevating table apparatus of claim 10 further comprising transverse support bars that span between the upper movable section of a leg.

20. An elevating table apparatus, comprising:

a) a table top having an underside and an upper surface that provides a work surface;

b) a plurality of three variable length telescoping legs attached to and supporting the table top, the legs each comprising a lower, smaller fixed section and an upper, larger movable section, each leg having a lower end portion and an upper end portion wherein the lower section telescopes inside the upper section;

c) a gear cluster positioned at the top of each leg that includes a plurality of gears that are engaged during use;

d) each leg having a hollow interior that holds a generally vertically extending, externally threaded rod, the rod having an upper end portion that carries and rotates with one of the gears of the gear cluster and a lower end portion that threadably engages a leg lower section;

e) a drive shaft having opposed ends, one end having a gear that forms a part of one of the gear clusters, the other end providing a crank;

f) a plurality of connecting linkages that extend between a center of the gear clusters and each of a pair of side gear clusters, wherein the gear clusters and connecting linkages are so configured that when the crank is rotated, all of the legs change length to alter the elevation of the table top.

21. The elevating table apparatus of claim 20 wherein each gear cluster includes at least one bevel gear.

22. The elevating table apparatus of claim 20 wherein each gear cluster includes a plurality of bevel gears.

23. The elevating table apparatus of claim 20 wherein the crank is configured to be manually rotatable.

24. The elevating table apparatus of claim 20 wherein the legs include a center leg in between two other legs.

25. The elevating table apparatus of claim 20 wherein each leg lower fixed section fits inside of a leg upper movable section.

26. The elevating table apparatus of claim 20 wherein each connecting rod extends next to the underside of the table top.

27. The elevating table apparatus of claim 20 wherein each gear cluster has a gear housing connected to the table top underside.

28. The elevating table apparatus of claim 27 wherein there are three gear housings that each are three bevel gears.

29. The elevating table apparatus of claim 20 further comprising transverse support bars that span between the upper movable section of a leg.

* * * * *